US012455133B1

(12) United States Patent
Richey

(10) Patent No.: US 12,455,133 B1
(45) Date of Patent: Oct. 28, 2025

(54) SYSTEM FOR COOLING AUTOMATIC FIREARMS AND CANNONS

(71) Applicant: Allen Wayne Richey, Cleveland, SC (US)

(72) Inventor: Allen Wayne Richey, Cleveland, SC (US)

( * ) Notice: Subject to any disclaimer, the term of this patent is extended or adjusted under 35 U.S.C. 154(b) by 0 days.

(21) Appl. No.: 18/926,684

(22) Filed: Oct. 25, 2024

(51) Int. Cl.
*F41A 21/24* (2006.01)
*F41A 21/02* (2006.01)

(52) U.S. Cl.
CPC ..... *F41A 21/24* (2013.01); *F41A 21/02* (2013.01)

(58) Field of Classification Search
CPC ..... F41A 21/02; F41A 21/10; F41A 21/20; F41A 21/24
See application file for complete search history.

(56) References Cited

U.S. PATENT DOCUMENTS

| | | | | |
|---|---|---|---|---|
| 1,452,123 | A * | 4/1923 | McCrudden | F41A 19/30 89/154 |
| 2,112,144 | A | 3/1938 | Coupland | |
| 2,287,066 | A | 6/1942 | Rogers | |
| 2,850,828 | A * | 9/1958 | Sullivan | F41A 21/04 42/76.02 |
| 2,935,912 | A * | 5/1960 | Hartley | F41A 13/12 42/76.02 |
| 2,981,155 | A * | 4/1961 | Parlanti | F41A 21/20 42/78 |
| 3,118,243 | A * | 1/1964 | Manshel | F41A 21/02 42/76.02 |
| 4,841,836 | A * | 6/1989 | Bundy | F41A 21/44 89/14.1 |
| 4,982,648 | A | 1/1991 | Bol et al. | |
| 5,837,921 | A | 11/1998 | Rinaldi et al. | |
| 6,311,602 | B1 | 11/2001 | Gerber et al. | |
| 7,418,848 | B2 | 9/2008 | Im | |
| 7,464,496 | B1 * | 12/2008 | Davies | F41A 21/24 42/75.02 |
| 2002/0083823 | A1 | 7/2002 | Gerber et al. | |
| 2003/0010187 | A1 * | 1/2003 | Muirhead | F28F 1/20 89/14.1 |
| 2014/0076135 | A1 * | 3/2014 | Balthaser | F41A 13/12 89/14.1 |
| 2016/0209144 | A1 | 7/2016 | Tertin et al. | |
| 2016/0273861 | A1 * | 9/2016 | Langenbeck | F41A 21/24 |
| 2017/0045322 | A1 | 2/2017 | Fiedorowicz | |
| 2017/0261280 | A1 * | 9/2017 | Glisovic | F41A 21/24 |
| 2018/0023913 | A1 * | 1/2018 | Newman | F41A 21/04 42/76.1 |
| 2018/0120044 | A1 * | 5/2018 | Lagenbeck | F41A 21/24 |
| 2020/0408477 | A1 * | 12/2020 | Glisovic | F41A 21/04 |
| 2024/0271896 | A1 | 8/2024 | Eck | |

FOREIGN PATENT DOCUMENTS

| | | | |
|---|---|---|---|
| FR | 836428 | A * | 1/1931 |
| FR | 1157227 | A * | 5/1958 |
| GB | 127282 | A * | 6/1919 |

OTHER PUBLICATIONS

Brass VS Copper: Their Difference. Lie, Jack. <https://web.archive.org/web/20230604212212/https://www.runsom.com/blog/brass-vs-copper-their-difference/>. Jun. 4, 2023. (Year: 2023).*

* cited by examiner

*Primary Examiner* — Gabriel J. Klein
(74) *Attorney, Agent, or Firm* — Thrive IP

(57) ABSTRACT

A barrel cooling system for a weapon includes a corrosion prevention cylinder between a barrel and cooling fins arranged around the cylinder.

4 Claims, 5 Drawing Sheets

SYSTEM FOR COOLING AUTOMATIC FIREARMS AND CANNONS

BACKGROUND OF THE DISCLOSURE

Rapid-fire weapons and firearms, such as machine guns, ground artillery, tanks, and airborne cannons, are well known. Due to their high firing rates, the barrels of such weapons become extremely hot, and if the heat is not quickly dissipated, the weapons can be damaged and rendered unusable. For decades, various attempts have been made to keep barrels cool, as well as adjacent receivers, chambers, and other parts of rapid-fire weapons and firearms, to protect them from excess heat. Some approaches use water-cooling, others use vents, and still others suggest changing barrels at different firing intervals.

Thus, known systems are complicated, limited to specific weapons, and/or do not succeed entirely in cooling barrels. A need exists for a cooling system that can be easily used with rapid-fire weapons and firearms to protect them from excess heat and damage.

BRIEF SUMMARY OF THE DISCLOSURE

The present disclosure is directed in general to a cooling system for barrels of weapons that are susceptible to excessive heat due to high rates of fire, such as machine guns, artillery, cannons, and other automatic weapons. Copper is one of the best conductors of heat, but it cannot be placed directly on or around steel, the material from which barrels are usually constructed, because copper and steel will corrosively react. Thus, the present disclosure provides a sleeve made from brass, nickel, chromium, and the like, which is placed between copper cooling fins and barrels to prevent corrosion while the copper fins act to dissipate heat caused by high rates of fire. The barrel, receiver, chamber, magazine, and other parts of the weapons are also protected from heat by the heat-dissipating copper fins. The fins in turn can be protected from bending or damage by an outer cover such as a perforated steel shield.

In one embodiment, a corrosion prevention cooling system for a barrel of a weapon may include a plurality of cooling fins; a weapon barrel; and a cylinder made of corrosion-prevention material, the cylinder interposed between the weapon barrel and the cooling fins, wherein, when ammunition is fired at a high rate through the weapon barrel, the cylinder permits the cooling fins to dissipate heat from the weapon barrel while simultaneously protecting the weapon barrel from corrosively reacting with the cooling fins.

In this embodiment, the cooling fins may be made from copper, the weapon barrel may be made from steel, and the cylinder may be made from chromium. However, the cylinder can also be made from brass, nickel, or the like, including combinations thereof with chromium.

In another embodiment, a corrosion prevention cooling system for a barrel of a weapon may include a plurality of cooling fins; a weapon barrel; and a cylinder having at least a first layer of corrosion-prevention material, a second layer of a different corrosion-prevention material, and a plurality of corrosion-prevention inserts interspersed throughout the first layer and the second layer, the cylinder being interposed between the weapon barrel and the cooling fins, wherein, when ammunition is fired through the weapon barrel at a high rate, the first layer, the second layer, and the inserts of the cylinder permit the cooling fins to dissipate heat away from the weapon barrel while protecting the weapon barrel from corrosively reacting with the cooling fins.

In this embodiment, the cooling fins may be made from copper, the barrel may be made from steel, and the first layer may be brass, nickel, or chromium while the second layer may be brass, nickel, or chromium but preferably different from the first layer. For example, if the first layer is brass, the second layer may be chromium.

Also in this embodiment, one or more inserts may be interspersed through the first layer or the second layer, or both. The inserts may be brass, nickel, chromium, or amalgams thereof. The inserts may be orthogonal to the layers and the barrel, although they can be in randomized patterns.

Additional objects and advantages of the present subject matter are set forth in, or will be apparent to, those of ordinary skill in the art from the description herein. Also, it should be further appreciated that modifications and variations to the specifically illustrated, referenced, and discussed features, processes, and elements hereof may be practiced in various embodiments and uses of the disclosure without departing from the spirit and scope of the subject matter. Variations may include, but are not limited to, substitution of equivalent means, features, or steps for those illustrated, referenced, or discussed, and the functional, operational, or positional reversal of various parts, features, steps, or the like. Those of ordinary skill in the art will better appreciate the features and aspects of the various embodiments, and others, upon review of the remainder of the specification.

BRIEF DESCRIPTION OF THE DRAWINGS

A full and enabling disclosure of the present subject matter, including the best mode thereof directed to one of ordinary skill in the art, is set forth in the specification, which refers to the appended figures, wherein.

DETAILED DESCRIPTION OF THE DISCLOSURE

Figure 1:
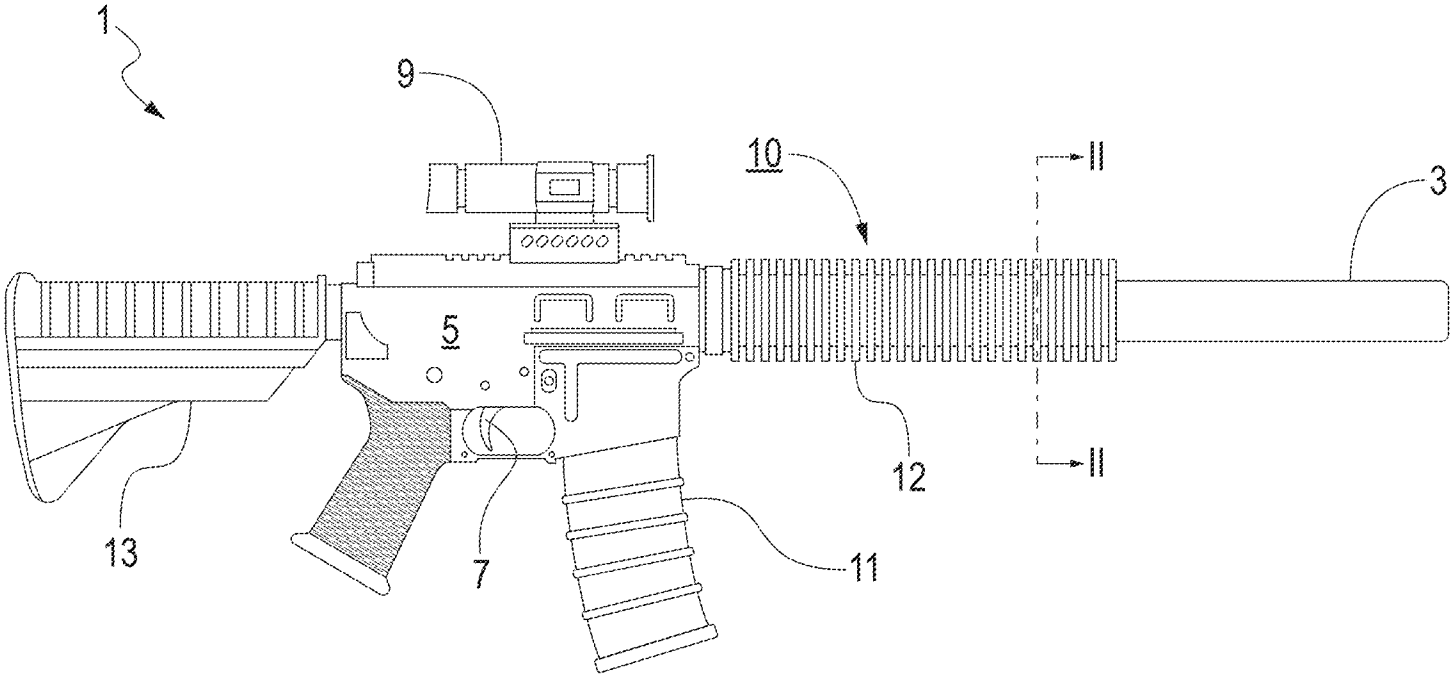
FIG. 1 is a side elevational view of a weapon having a cooling system according to an aspect of the disclosure.

As required, detailed embodiments are disclosed herein; however, the disclosed embodiments are merely examples and may be embodied in various forms. Therefore, specific structural and functional details disclosed herein are not to be interpreted as limiting, but merely as a basis for the claims and as a representative basis for teaching one skilled in the art to variously employ the exemplary embodiments of the present disclosure, as well as their equivalents.

Unless defined otherwise, all technical, engineering, and scientific terms used herein have the same meaning as is commonly understood by one of ordinary skill in the art to which this disclosure belongs. In the event that there is a plurality of definitions for a term, phrase, or acronym herein, those in this section prevail unless stated otherwise.

Wherever the phrase "for example," "such as," "including," and the like are used herein, the phrase "and without limitation" is understood to follow unless explicitly stated otherwise. Similarly, "an example," "exemplary," and the like are understood to be non-limiting.

The term "substantially" allows for deviations from the descriptor that do not negatively impact the intended purpose. Descriptive terms are understood to be modified by the term "substantially" even if the word "substantially" is not explicitly recited.

The term "about" when used in connection with a numerical value refers to the actual given value, and to the approximation to such given value that would reasonably be inferred by one of ordinary skill in the art, including approximations due to the experimental and or measurement conditions for such given value.

The term "ranges" includes all combinations of sub-ranges. For instance, a range from 100-200 includes ranges from, e.g., 110 to 150, 170 to 190, and 153 to 162. Similarly, "limits" means all sub-limit combinations, e.g., a limit of up to 7 also includes a limit of up to 5, up to 3, and up to 4.5.

The terms "comprising" and "including" and "having" and "involving" (and similarly "comprises," "includes," "has," and "involves") and the like are used interchangeably and have the same meaning. Specifically, each of the terms is defined consistent with the common United States patent law definition of "comprising" and is therefore interpreted to be an open term meaning "at least the following," and is also interpreted not to exclude additional features, limitations, aspects, et cetera. Thus, for example, "a device having components a, b, and c" means that the device includes at least components a, b, and c. Similarly, a phrase such as: "a method involving a, b, and c" means that the method includes at least steps a, b, and c.

Where a list of alternative component terms is used, e.g., "a structure such as 'a,' 'b,''c,' 'd' or the like," or "a or b," such lists and alternative terms provide meaning and context for the sake of illustration, unless indicated otherwise. Also, relative terms such as "first," "second," "third," "front," and "rear" are intended to identify or distinguish one component or feature from another similar component or feature, unless indicated otherwise herein.

Unless the context clearly requires otherwise, throughout the description and the claims, the words "comprise," "comprising," and the like are to be construed in an inclusive sense as opposed to an exclusive or exhaustive sense; in the sense of "including, but not limited to."

The various embodiments of the disclosure and/or equivalents falling within the scope of present disclosure overcome or ameliorate at least one of the disadvantages of the prior art or provide a useful alternative.

Detailed reference will now be made to the drawings in which examples embodying the present subject matter are shown. The detailed description uses numerical and letter designations to refer to features of the drawings. The drawings and detailed description provide a full and written description of the present subject matter, and of the manner and process of making and using various exemplary embodiments, so as to enable one skilled in the pertinent art to make and use them, as well as the best mode of carrying out the exemplary embodiments. The drawings are not necessarily to scale, and some features may be exaggerated to show details of particular components. Thus, the examples set forth in the drawings and detailed descriptions are provided by way of explanation only and are not meant as limitations of the disclosure. The present subject matter thus includes any modifications and variations of the following examples as come within the scope of the appended claims and their equivalents.

Turning now to FIG. 1, a weapon is broadly designated by element number 1 with a cooling system 10. The weapon 1 may be a rifle, a mechanized or airborne cannon, an artillery piece, a machine gun, and the like, all having barrels 3 that are susceptible to overheating due to rapid fire. In this example, the weapon 1 is a rifle that includes the barrel 3, a receiver assembly 5, a trigger 7, a scope 9, a magazine 11, and a shoulder stock 13. Here, the cooling system 10 is shown with copper cooling projections or fins 12 arranged about the barrel 3. As will be explained in greater detail below, the copper cooling fins 12 dissipate heat from the barrel 3 to prevent overheating and damage to the barrel 3 that could render the weapon 1 unusable.

Figure 2:
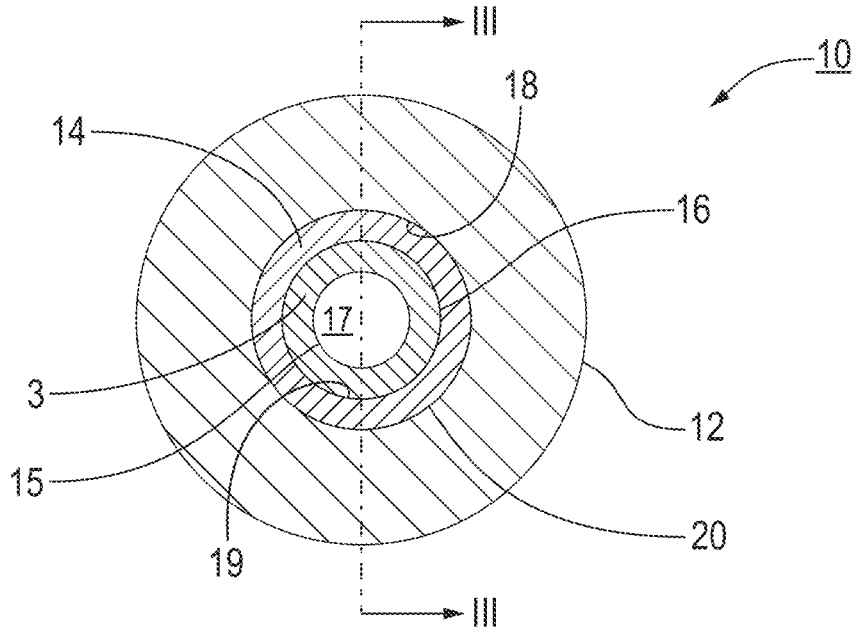
FIG. 2 is a cross section of the weapon and cooling system taken along lines II-II in FIG. 1.

With reference to FIG. 2, the cooling fins 12 are attached to or around a corrosion prevention ring, cylinder, sleeve, or insert 14 that, as shown, is interposed between the barrel 3 and the cooling fins 12. More particularly, the cylinder 14 can be made of chromium, brass, nickel, and the like to prevent the copper cooling fins 12 from contacting the barrel 3, which will typically be made of hardened steel or the like. Without the cylinder 14 over time the copper cooling fins 12 could corrosively react with the steel barrel 3.

FIG. 2 further shows that that the barrel 3 has an inner surface 15 that forms a bore 17 and an outer surface 19 that adjoins or abuts an inner surface 16 of the cylinder 14, which also has an outer surface 18 that in turn adjoins or abuts an inner surface 20 of the cooling fins 12. Thus, the corrosion-resistant material of the inner surface 16 contacts the barrel 3 to assist the copper cooling fins 12 in dissipating heat during firing of the weapon 1 while simultaneously preventing corrosion.

Figure 3:
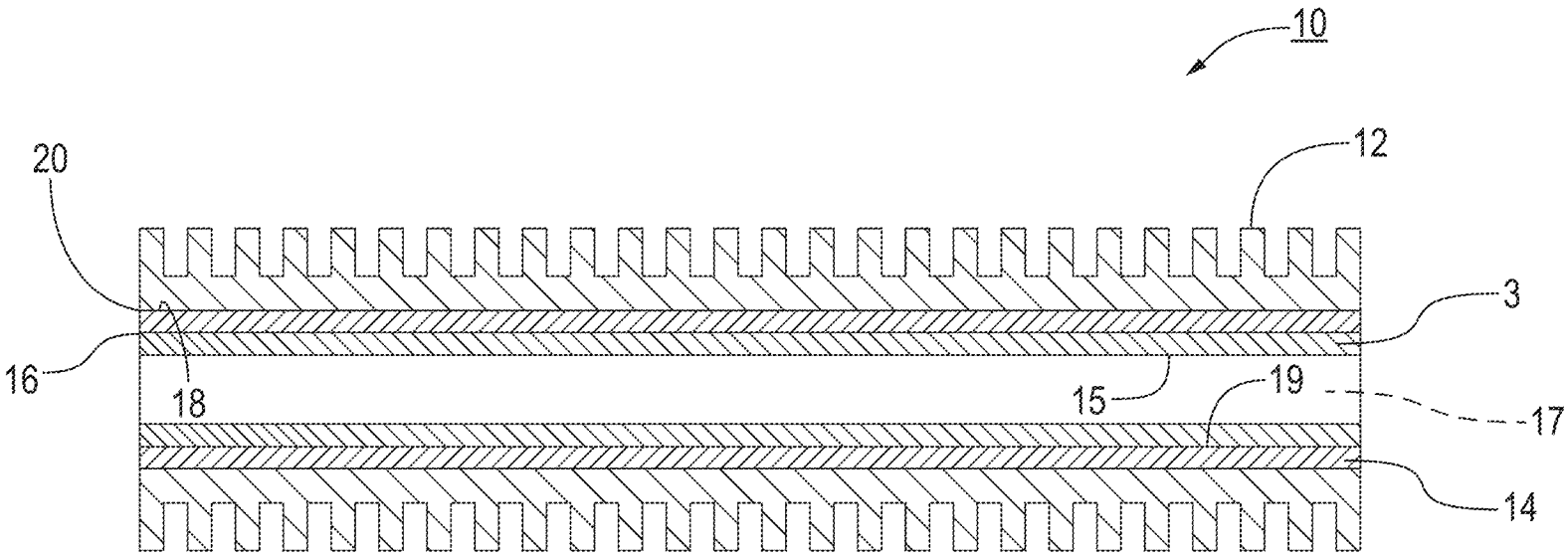
FIG. 3 is a cross section taken along lines III-III in FIG. 2.

FIG. 3 shows the cooling system 10 in cross section from a side elevational perspective. As noted above with respect to FIG. 2, the barrel 3 has the inner surface 15 that forms the bore 17 and the outer surface 19 that adjoins the inner surface 16 of the cylinder 14. The outer surface 18 of the cylinder 14 is shown abutting the inner surface 20 of the cooling fins 12.

Assorted sizes, shapes, and dimensions of the exemplary cooling fins 12 are possible and are not limited to the examples shown and described. Further, the cylinder 14 may be made of many combinations of chromium, brass, nickel, and the like, including having slugs or cylinders of brass, for instance, inserted at intervals along a length of the cylinder 14, which could be primarily made from chromium. Still further, the cylinder 14 could have multiple layers. For example, a layer adjoining the outer surface 19 of the barrel 3 could be chromium and a layer of the cylinder 14 adjoining the inner surface 20 of the cooling fins 12 could be brass.

Figure 4:
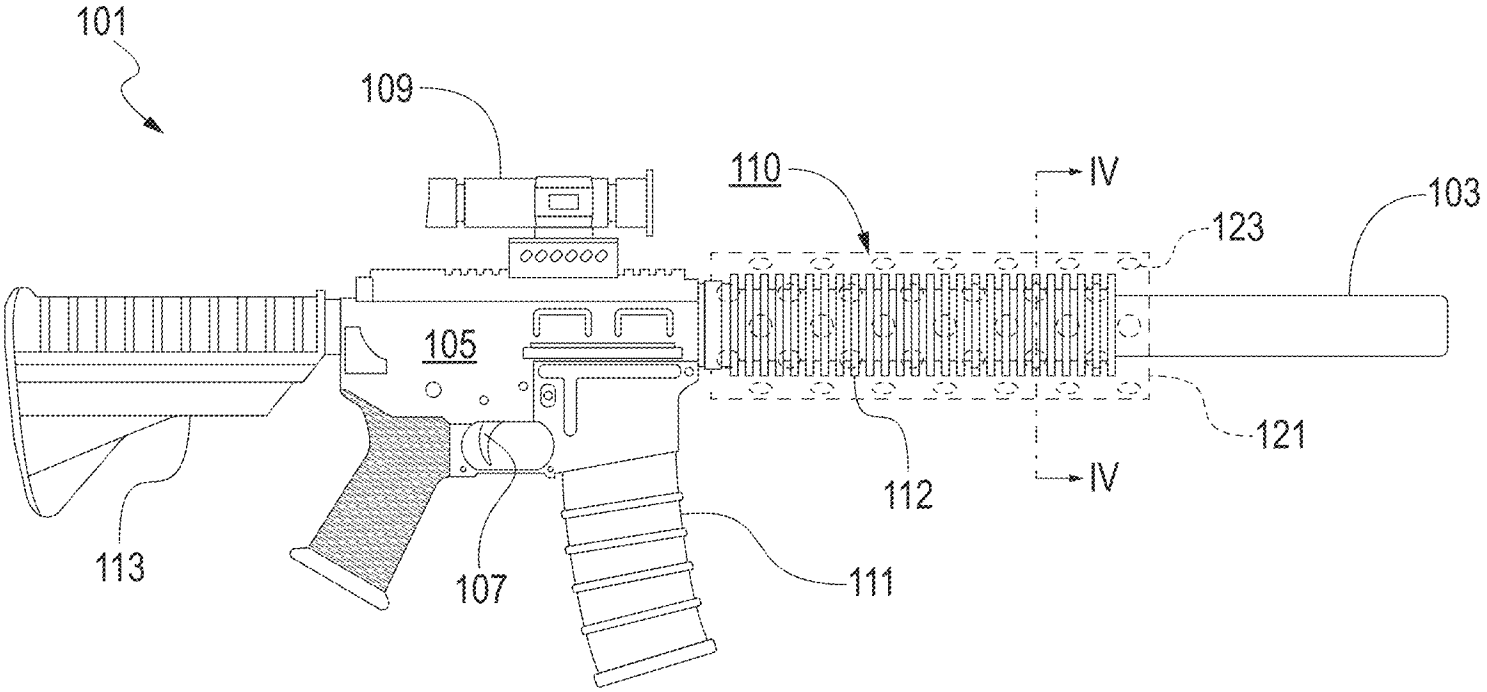
FIG. 4 is a side elevational view of another weapon having a cooling system according to another aspect of the disclosure.

Turning to FIG. 4, a weapon is broadly designated by element number 101 with a cooling system 110. The weapon 101 may be a rifle, a mechanized or airborne cannon, an artillery piece, a machine gun, and the like, all having barrels 103, typically made of steel, that are susceptible to overheating due to rapid firing of ammunition (not shown). In this example, the weapon 101 is a rifle that includes the barrel 103, a receiver assembly 105, a trigger 107, a scope 109, a magazine 111, and a shoulder stock 113. Also shown, the cooling system 110 includes copper cooling projections or fins 112 arranged about the barrel 103 to dissipate heat from the barrel 103 and prevent overheating and damage that could render the weapon 101 unusable. Still further, a perforated shield 121 having holes or vents 123 may be installed over or around all or portions of the cooling fins 112 to protect the fins 112 from damage, e.g., if the weapon 101 is dropped on the ground or impacted by external objects. The vents 123 permit ambient air to circulate about the cooling fins 112 and permit heat to escape.

Figure 5:
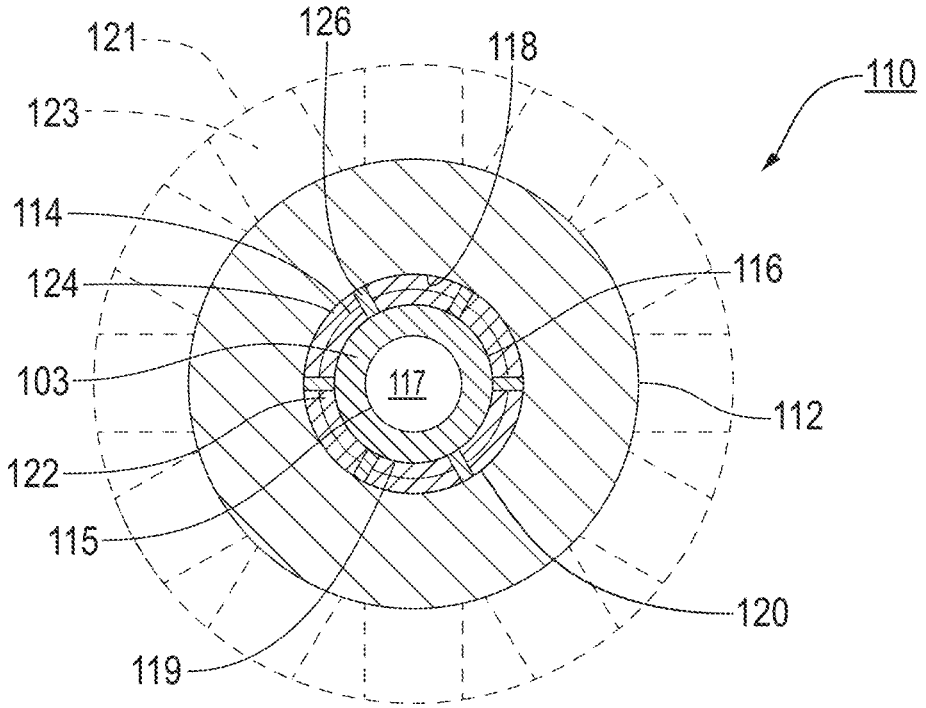
FIG. 5 is a cross section of the weapon and cooling system taken along lines IV-IV in FIG. 4.

As shown more particularly in FIG. 5, the cooling fins 112 are attached to or around a corrosion prevention ring, cylinder, sleeve, or insert 114 that, as shown, is interposed between the steel barrel 103 and the copper cooling fins 112. More particularly, the cylinder 114 may have at least two layers 122 and 124. One layer 122 may be made of chromium, brass, nickel, or the like and the other layer 124 may be made of a different one of the chromium, brass, nickel, or the like. For instance, layer 122 may be made of chromium and layer 124 may be made of brass such that the layers 122, 124 of the cylinder 114 act in concert to prevent the copper cooling fins 112 from contacting the steel barrel 103 to prevent a corrosive reaction. Still further, one or more rods or inserts 126, made of yet another material such as chromium, brass, nickel, or the like, or an amalgam of non-corrosive metals, may be inserted through one or both layers 122, 124 of the cylinder 114 to facilitate further cooling. By way of example, if the layer 122 is chromium and the layer 124 is brass, the inserts 126 may be nickel.

FIG. 5 further shows that that the barrel 103 has an inner surface 115 that forms a bore 117 and an outer surface 119 that adjoins or abuts an inner surface 116 of the layer 122 of the cylinder 114, which in turn has an outer surface 118 that adjoins or abuts an inner surface 120 of the cooling fins 112. Thus, the corrosion-resistant material of the inner surface 116 contacts the barrel 103 to assist the copper cooling fins 112 in dissipating heat during firing of the weapon 101 while simultaneously preventing corrosion.

While the present subject matter has been described in detail with respect to specific embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

By way of example and not of limitation, exemplary embodiments as disclosed herein may include but are not limited to:

EMBODIMENT 1: A corrosion prevention cooling system for a barrel of a weapon, comprising a plurality of cooling fins; a weapon barrel; and a cylinder made of corrosion-prevention material, the cylinder interposed between the weapon barrel and the cooling fins, wherein, when ammunition is fired at a high rate through the weapon barrel, the cylinder permits the cooling fins to dissipate heat from the weapon barrel while simultaneously protecting the weapon barrel from corrosively reacting with the cooling fins.

EMBODIMENT 2: The corrosion prevention cooling system as in Embodiment 1, wherein the cooling fins are made from copper.

EMBODIMENT 3: The corrosion prevention cooling system as in Embodiments 1 or 2, wherein the weapon barrel is made from steel.

EMBODIMENT 4: The corrosion prevention cooling system as in any of the foregoing embodiments, wherein the cylinder is made from chromium.

EMBODIMENT 5: The corrosion prevention cooling system as in any of the foregoing embodiments, wherein the cylinder is made from a material selected from the group consisting of brass, nickel, chromium, and combinations thereof.

EMBODIMENT 6: A corrosion prevention cooling system for a barrel of a weapon, comprising a plurality of cooling fins; a weapon barrel; and a cylinder having at least a first layer of corrosion-prevention material, a second layer of a different corrosion-prevention material, and a plurality of corrosion-prevention inserts interspersed throughout the first layer and the second layer, the cylinder being interposed between the weapon barrel and the cooling fins, wherein, when ammunition is fired through the weapon barrel at a high rate, the first layer, the second layer, and the inserts of the cylinder permit the cooling fins to dissipate heat away from the weapon barrel while protecting the weapon barrel from corrosively reacting with the cooling fins.

EMBODIMENT 7: The corrosion prevention cooling system for a barrel of a weapon as in Embodiment 6, wherein the cooling fins are made from copper.

EMBODIMENT 8: The corrosion prevention cooling system for a barrel of a weapon as in Embodiments 6 or 7, wherein the barrel is made from steel.

EMBODIMENT 9: The corrosion prevention cooling system for a barrel of a weapon as in Embodiments 6, 7, or 8, wherein the first layer is made of brass, nickel, or chromium, and the second layer is made of one of brass, nickel, or chromium not forming the first layer.

EMBODIMENT 10: The corrosion prevention cooling system for a barrel of a weapon as in Embodiments 6 through 9, further comprising a plurality of inserts interspersed through at least one of the first layer and the second layer, the inserts being made from a material selected from the group consisting of brass, nickel, chromium, and combinations thereof.

The invention claimed is:

1. A corrosion prevention cooling system for a barrel of a weapon, comprising:

a plurality of cooling fins;

a weapon barrel; and a cylinder having at least a first layer of corrosion-prevention material being made of brass, nickel, or chromium, a second layer of a different corrosion-prevention material being made of brass, nickel, or chromium not forming the first layer, and a plurality of corrosion-prevention inserts interspersed throughout the first layer and the second layer, the cylinder being interposed between the weapon barrel and the cooling fins, wherein, when ammunition is fired through the weapon barrel, the first layer, the second layer, and the inserts of the cylinder permit the cooling fins to dissipate heat away from the weapon barrel while protecting the weapon barrel from corrosively reacting with the cooling fins.

2. The corrosion prevention cooling system for a barrel of a weapon as in claim 1, wherein the cooling fins are made from copper.

3. The corrosion prevention cooling system for a barrel of a weapon as in claim 1, wherein the barrel is made from steel.

4. The corrosion prevention cooling system for a barrel of a weapon as in claim 1, further comprising a plurality of inserts interspersed through at least one of the first layer and the second layer, the inserts being made from a material selected from the group consisting of brass, nickel, chromium, and combinations thereof.

* * * * *